US012540795B2

(12) United States Patent
Karagias

(10) Patent No.: US 12,540,795 B2
(45) Date of Patent: Feb. 3, 2026

(54) MODULAR SCOPE MOUNTING SYSTEM WITH SERRATED INTERFACES FOR MOUNTING COMPONENTS

(71) Applicant: Theodore Karagias, Seattle, WA (US)

(72) Inventor: Theodore Karagias, Seattle, WA (US)

( * ) Notice: Subject to any disclaimer, the term of this patent is extended or adjusted under 35 U.S.C. 154(b) by 0 days.

(21) Appl. No.: 18/369,139

(22) Filed: Sep. 15, 2023

(65) Prior Publication Data

US 2024/0093967 A1 Mar. 21, 2024

Related U.S. Application Data

(60) Provisional application No. 63/407,108, filed on Sep. 15, 2022.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 3,406,455 A * 10/1968 Akin, Jr. ..... F41G 11/005 248/316.6
3,559,940 A * 2/1971 Kruzell ..... F41G 11/001 248/223.41
4,776,126 A * 10/1988 Williams ..... F41G 11/003 D22/110
4,875,290 A * 10/1989 Finch ..... F41G 1/467 42/137
5,433,010 A * 7/1995 Bell ..... F41G 11/003 42/122
5,787,630 A * 8/1998 Martel ..... F41G 11/003 42/127
5,806,228 A * 9/1998 Martel ..... F41G 11/003 42/124
5,887,375 A * 3/1999 Watson ..... G03B 29/00 42/106
5,941,226 A * 8/1999 Marietta ..... F41G 1/467 124/87
6,073,351 A * 6/2000 Barnett ..... F41G 1/467 42/142
6,295,754 B1 * 10/2001 Otteman ..... F41G 11/003 42/111
7,743,543 B2 6/2010 Karagias
8,171,666 B2 5/2012 Karagias
(Continued)

OTHER PUBLICATIONS

U.S. Appl. No. 62/590,224, filed Nov. 22, 2017.
(Continued)

*Primary Examiner* — Michelle Clement
(74) *Attorney, Agent, or Firm* — Perkins Coic LLP

(57) ABSTRACT

Firearms and accessories are disclosed herein. The firearm can carry a scope mounting assembly configured to couple to a firearm and includes serrated interfaces configured to engage a complementary serrated interface of a component such that the component is rotationally and translationally fixed to the scope mounting assembly. The interlocked serrated interface maintains positional relationships between the component and another component, such as a scope, and/or the firearm.

17 Claims, 13 Drawing Sheets

(56) References Cited

U.S. PATENT DOCUMENTS

| | | | | |
|---|---|---|---|---|
| 8,327,574 | B2 * | 12/2012 | Sandler | F41G 11/003 42/126 |
| 8,528,140 | B1 * | 9/2013 | Phillips | F41G 11/003 12/111 |
| 8,572,885 | B2 | 11/2013 | Karagias | |
| D713,921 | S * | 9/2014 | Williams | D22/109 |
| 9,097,478 | B1 | 8/2015 | Karagias | |
| 9,377,255 | B2 | 6/2016 | Karagias | |
| 9,395,138 | B2 * | 7/2016 | Troy, Jr. | F41C 27/00 |
| 9,453,707 | B2 * | 9/2016 | Williams | F41G 1/387 |
| 9,470,480 | B2 * | 10/2016 | Kirchhoff | F41G 11/001 |
| 9,574,834 | B2 | 2/2017 | Karagias | |
| 9,599,432 | B2 * | 3/2017 | Neville | F41C 27/18 |
| 9,909,839 | B1 * | 3/2018 | Hamm | F41G 1/41 |
| 10,082,356 | B2 | 9/2018 | Karagias | |
| 10,119,788 | B2 * | 11/2018 | Kennair, Jr. | F41G 11/003 |
| 10,352,658 | B1 * | 7/2019 | Aslin | F41G 11/003 |
| 10,458,733 | B2 | 10/2019 | Karagias | |
| 10,801,814 | B2 * | 10/2020 | Ma | F41G 11/003 |
| 10,852,104 | B2 * | 12/2020 | Aslin | F41G 11/001 |
| 10,982,921 | B2 | 4/2021 | Karagias | |
| 11,067,347 | B2 | 7/2021 | Karagias | |
| 11,105,494 | B2 * | 8/2021 | Ma | F21L 4/00 |
| 11,112,216 | B1 * | 9/2021 | Fan | F41G 11/00 |
| 11,768,366 | B1 * | 9/2023 | Gilman | G02B 23/16 74/543 |
| 12,055,367 | B2 * | 8/2024 | Lee | F41G 11/001 |
| 12,104,880 | B2 * | 10/2024 | Chester | F41G 11/003 |
| 2001/0045046 | A1 * | 11/2001 | Otteman | F41G 1/38 42/136 |
| 2008/0022576 | A1 * | 1/2008 | Epling | F41G 1/38 42/124 |
| 2010/0024274 | A1 * | 2/2010 | Lippard | F41A 19/43 42/70.05 |
| 2010/0064535 | A1 * | 3/2010 | Kingsbury | F41G 1/345 33/265 |
| 2012/0285067 | A1 * | 11/2012 | Kitzen | F41G 11/003 42/90 |
| 2014/0096429 | A1 * | 4/2014 | Sandler | F41G 11/003 42/124 |
| 2017/0241741 | A1 * | 8/2017 | Campbell | F41C 27/00 |
| 2018/0073840 | A1 * | 3/2018 | Kristoffersen | F41G 1/16 |
| 2018/0087875 | A1 * | 3/2018 | Yost | F41G 1/26 |
| 2021/0341249 | A1 | 11/2021 | Karagias | |
| 2022/0074687 | A1 | 3/2022 | Karagias | |
| 2023/0258431 | A1 * | 8/2023 | Bordson | F41G 11/003 42/106 |
| 2023/0358507 | A1 * | 11/2023 | Bordson | F41G 11/001 |

OTHER PUBLICATIONS

U.S. Appl. No. 62/590,232, filed Nov. 22, 2017.
U.S. Appl. No. 62/590,236, filed Nov. 22, 2017.
U.S. Appl. No. 62/590,239, filed Nov. 22, 2017.
U.S. Appl. No. 62/590,243, filed Nov. 22, 2017.

* cited by examiner

MODULAR SCOPE MOUNTING SYSTEM WITH SERRATED INTERFACES FOR MOUNTING COMPONENTS

CROSS-REFERENCE TO RELATED APPLICATION

This application claims the benefit of U.S. Provisional Patent Application No. 63/407,108, filed on Sep. 15, 2022, which is incorporated herein by reference in its entirety.

TECHNICAL FIELD

The present invention relates generally to scope mounting systems. More specifically, the invention relates to modular scope mounting systems for firearms.

BACKGROUND

Scope mounts are used for connecting telescopic scopes and other aiming or targeting devices to firearms. The positional relationship between aiming or targeting devices, such as telescopic scopes and laser ranging devices, should be preserved if they are to function properly and remain useful. Unfortunately, misalignment of aiming devices can be caused by installation mispositioning, recoil, and firearm mishandling, resulting in compromised target identification, inaccurate distance measurements, and impairment of overall aiming performance. Misalignment problems often necessitate time-consuming adjustments and recalibrations in the field. Shooters may spend valuable time troubleshooting and correcting misalignment, affecting their ability to make accurate and timely shots. For example, when misalignment of laser ranging devices occur, the laser beam emitted by the devices may not accurately converge with a line of sight through scope or sight of the firearm, leading to incorrect distance readings and subsequent targeting errors. The accuracy of a shot in rifle shooting depends heavily on knowing the precise distance to the target, so the misalignment can introduce inaccuracies in distance measurements, causing shooters to miscalculate bullet trajectories, elevation adjustments, and/or windage corrections. These inaccuracies can result in missed shots, wounded game, and/or compromised military and law enforcement operations.

DETAILED DESCRIPTION

Figure 1:
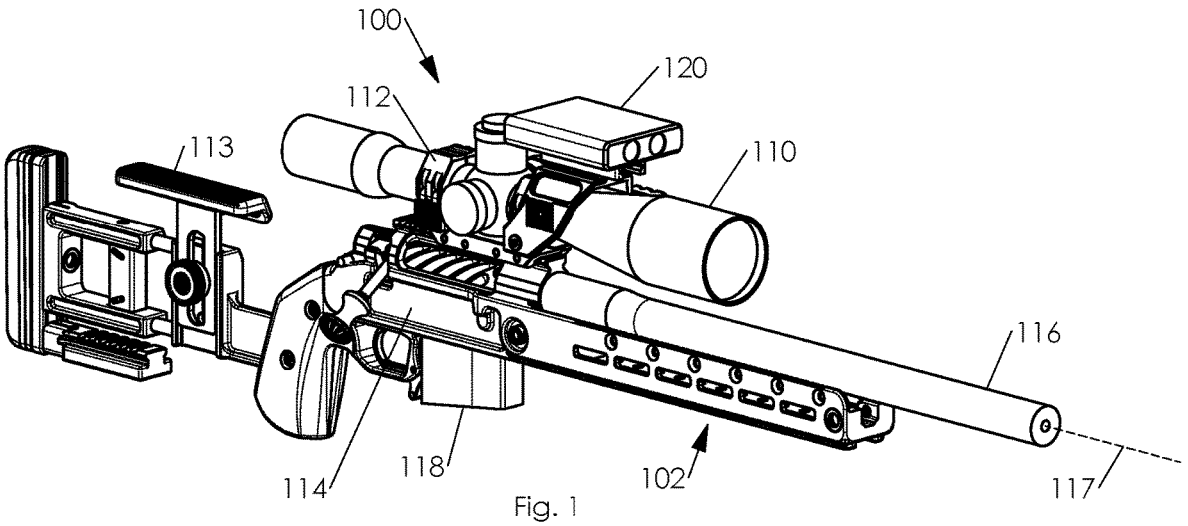
FIG. 1 is an isometric view of a firearm and a modular targeting assembly coupled to the firearm, in accordance with some embodiments.

At least some embodiments are modular scope mounting systems configured to effectively preserve the positional relationships between various devices connected to a firearm and to one another. The modular scope mounting system has fixation interfaces at the junction between components designed for holding various devices, such as sights (e.g., telescopic sights or scopes, laser sights, etc.), laser ranging devices, laser pointers, lights, optics, GPS devices, range cards, batteries, levels (e.g., spirit levels, bubble levels, etc.), or any other device that may be connected to a firearm to, for example, enhance functionality of the firearm system. The fixation interfaces can include features that interlock to substantially prevent, limit, or minimize relative movement between the components. For example, the fixation interfaces can include serrated interfaces that provide interlocking for immobilization, relatively large contact areas, capability to withstand significant external loads, repeatable precision assembly, repairability, tactile feedback during assembly, and/or improved alignment maintenance. The serrated interfaces can include a series of alternating features (e.g., ridges and grooves, teeth, channels, etc.), creating a highly effective mechanism for enhancing the performance and longevity of the interfaces.

As the components are brought together, interfaces can engage to form an interlocking connection. The interlocking connection can immobilize the joint and counteract externally applied forces, moments, loading, etc. This prevents unintentional shifting or misalignment of the components, even under dynamic loads or vibrations, including when a firearm is discharged. The fixation interfaces can be held forcefully together by one or more couplers (e.g., fasteners, threaded members, screws, pins, etc.) that pass through them to reduce, limit, or substantially eliminate relative movement between components. For example, the interlocking can provide a constraint that can resist slippage more effectively than a connection relying solely on friction. The interlocking features of fixation interfaces can be regularly or irregularly spaced to allow for positioning flexibility of the components and can, for example, be sinusoidal-shaped, saw-tooth-shaped, or have other shapes. In some embodiments, the fixation interfaces are serrated interfaces with serrations that define included angles of, for example, 50 degrees, 60 degrees, 70 degrees, etc., at a pitch of, for example, 1 mm, 1.5 mm, 2 mm, etc. The pitch, height, angles, serration patterns (e.g., aligned patterns, parallel patterns, radial patterns, Hirth patterns, herringbone patterns, etc.), profiles, and/or number of serrations (e.g., 5, 10, 15, 20, 25, 50, etc.) can be selected based on the application. For assembly, a fastener can be used to align spaced apart serrated interfaces to keep serrations aligned when the serrated interfaces are brought into contact with one another. The fastener can be tensioned to hold the joint together. The description of one of the fixation interfaces applies to other fixation interfaces, unless indicated otherwise.

At least some embodiments are directed to fixation interfaces that position aiming devices during installation and maintain positional relationships during firearm use for accurate distance measurements, improved target identification, and improved overall aiming device performance. The fixation interfaces can prevent time-consuming adjustments and recalibrations in the field so that shooters can make accurate and timely shots. In some embodiments, a scope mount includes one or more fixation interfaces. The fixation interfaces can maintain positional relationships between components with repeated disassembly and assembly to maintain usefulness of the assembly without subsequent relative adjustments of the components. The joints can prevent micromotions (e.g., translations equal to or greater than 10 microns, 25 microns, 40 microns, etc.) for joint stability even under high externally applied loads (e.g., if the firearm is dropped onto a hard surface).

In some embodiments, a scope mounting system for a firearm comprises a scope mounting assembly configured to couple to a mounting rail of a firearm. The scope mounting assembly includes a pair of scope rings and at least one serrated interface configured to engage a complementary-shaped serrated interface of a component such that the component is rotationally and translationally fixed to the scope mounting assembly to maintain a positional relationship between the component and a scope held by the pair of scope rings. The serrated interface can provide tactile feedback indicating, for example, when the components are interlocked and capable of withstanding high externally applied loads.

At least some embodiments, a scope mount for a firearm comprises at least one scope ring configured to hold a telescopic scope, at least one clamp connected to the at least one scope ring and configured to couple to the firearm, and a fixation interface. The fixation interface includes a plurality of ridges and a fastener opening. The plurality of ridges define grooves configured such that the fixation interface receives an accessory fixation interface to rotationally lock the accessory fixation interface to the fixation interface.

A scope mounting clamp couplable to a firearm comprises at least one arcuate ring cap and a ring base configured to cooperate with the at least one arcuate ring cap to define an opening for receiving a scope. The ring base includes at least one serrated interface spaced apart from the at least one arcuate ring cap. The scope mounting clamp includes a clamp mechanism connected to the ring base. The clamp mechanism is configured to move from an open position to a closed position to clamp onto the firearm.

In some embodiments, an assembly includes an aiming interface configured to hold an aiming device for a firearm and at least one serrated interface. The serrated interface can be connected to the aiming interface and configured to connect at least one component to the firearm with precise positional repeatability. The precise positional repeatability can be equal to or less than 1 minute of angle when the aiming interfaces are interlocked. For example, the interfaces can provide positional repeatability between targeting components, such as a scope and a laser range finder which should point to the same object at long range.

In some embodiments, sighting and targeting assemblies can include, without limitation, sights, scope, cameras (e.g., without or with sights and/or scopes), guidance systems (e.g., AR/VR guidance systems), targeting systems, and other mounting assemblies and components. The components can be interchangeable due to their matching serrated interfaces. This allows for reconfiguration of the sighting and targeting assemblies using a wide range of different modular components.

At least some embodiments include an assembly device coupleable to a firearm, and the assembly device utilizing at least one serrated interface to mechanically connect or integrate various devices for targeting, data acquisition, data transmitting, and/or data receiving. The components can include, for example, one or more cameras, sights, optic systems, lasers, lights, guidance systems (e.g., AR/VR guidance systems), and/or targeting systems. In some embodiments, the assembly device can include clamps, scope rings, rails, or combinations thereof.

Various embodiments disclosed herein can provide positional repeatability between components, such as scope and laser range finder as they need to point to the same object at long range. The interfaces can be damage tolerant because they can be easily repaired to restore maximum performance. The interfaces can resist micromotion even under high externally applied loads for joint stability. The interfaces are configured to provide the ability to decontaminate the serrated interface using the serrated interface itself. For example, interfaces can be slid against one another to push contaminates out of grooves.

FIG. 1 shows a sighting or targeting assembly 100 mounted on a firearm 102. The targeting assembly 100 includes a telescopic sight or scope 110 ("scope 110") and a modular scope mounting system or assembly 112 ("scope mounting assembly 112") holding the scope 110. The firearm 102 can be a rifle with a butt stock 113, a firing mechanism 114, and a barrel 116. The firing mechanism 114 receives ammunition from a magazine 118. The scope mounting assembly 112 can be coupled to different types of firearms 102, such as a handgun (e.g., a pistol, a revolver, etc.), an air gun, or other type of device used to shoot projectiles, such as a crossbow, and carry accessories at preset positions to maintain positional relationships between components. For example, the scope mounting assembly 112 can include one or more fixation interfaces configured to mate with complementary fixation interfaces of accessories, such as a laser device 120 (e.g., a laser range finder device, laser ranging device, laser sight device, etc.), lights, optics, levels (e.g., spirit levels, bubble levels, etc.), or any other device that enhances functionality of the firearm 102.

Figure 2:
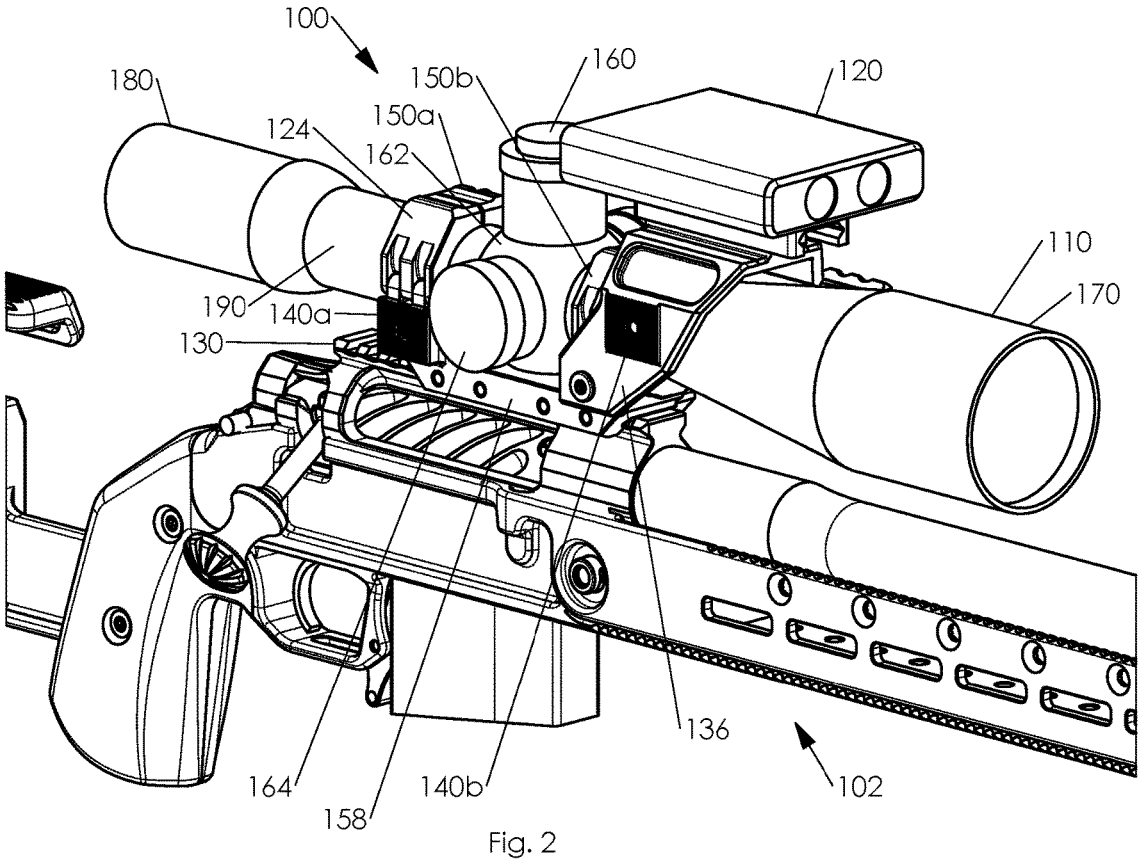
FIG. 2 is a detailed view of a portion of the firearm and the modular targeting assembly of FIG. 1.

FIG. 2 is a detailed view of the scope mounting assembly 112 mounted to a mounting rail 130 of the firearm 102. The scope mounting assembly 112 can include a scope mount 124 holding the scope 110 and a primary accessory mount 136 coupled to the scope mount 124. A laser device 120 of the targeting assembly 100 is coupled to the primary accessory mount 136. The scope mount 124 can include fixation interfaces in the form of serrated interfaces 140*a*, 140*b* (collectively "serrated interfaces 140") configured to engage complementary serrated interfaces of components such that the components are fixed (e.g., rotationally fixed and/or translationally fixed) to the scope mount 124, thereby maintaining positional relationships between the components and the scope 110, between the components and the firearm 102, and/or between themselves. For example, components (e.g., lights, optics, etc.) can be mounted to the side of the targeting assembly 100 by coupling the components to the serrated interfaces 140. The number, position, and configuration of the serrated interfaces can be selected based on the number, position, and positional accuracy of the components to be mounted.

With continued reference to FIG. 2, the scope mount 124 can include a clamp 158 coupled to the mounting rail 130 and a pair of scope rings 150*a*, 150*b* (collectively "scope rings 150") coupled to, or integrated with, the rail clamp 158. The mounting rail 130 can be an accessory rail or other type of rail or feature to which components can be coupled. The scope 110 can be a telescopic sight or other aiming device. Sights can include optical components, such as optical trains, objective lenses, ocular lenses, reticles, and other lenses that cooperate to provide desired viewing functionality. The scope 110 includes a windage and elevation adjustment mechanism 160. A user may rotate dials 162, 164 to establish the desired windage or elevation setting. The scope 110 may also include other types of controls or adjustment mechanisms and can include an objective 170, an eyepiece 180, and a tubular section 190 extending between the objective 170 and the eyepiece 180. The objective 170 carries objective lenses, and the eyepiece 180 carries ocular lenses. Imaging optics (e.g., an erector assembly, zoom assembly, reticle, combinations thereof, or the like) can be within and protected by the tubular section 190. Light can propagate through the imaging optics to provide an image to the observer.

The illustrated adjustment mechanism 160 is positioned between the scope rings 150*a*, 150*b*, and the serrated interfaces 140 can be spaced apart from the windage and elevation adjustment mechanism 160 such that mounted accessories (e.g., laser device 120) do not obstruct access to the dials 162, 164. The preservation of the positional relationship between the scope 110 and the laser device 120 can be preserved so that the aligned laser device 120 emits a laser beam to determine the exact distance to the target. To ensure the laser illuminates the target as seen through the scope 110, both devices can be aligned because misalignment can result in incorrect distance calculations, missed shots, and/or inaccurate targeting information. A shooter can use the laser device 120 and scope 110 to quickly measure the distance to the target and make real-time adjustments to the elevation and windage settings of the scope 110.

Figure 3:
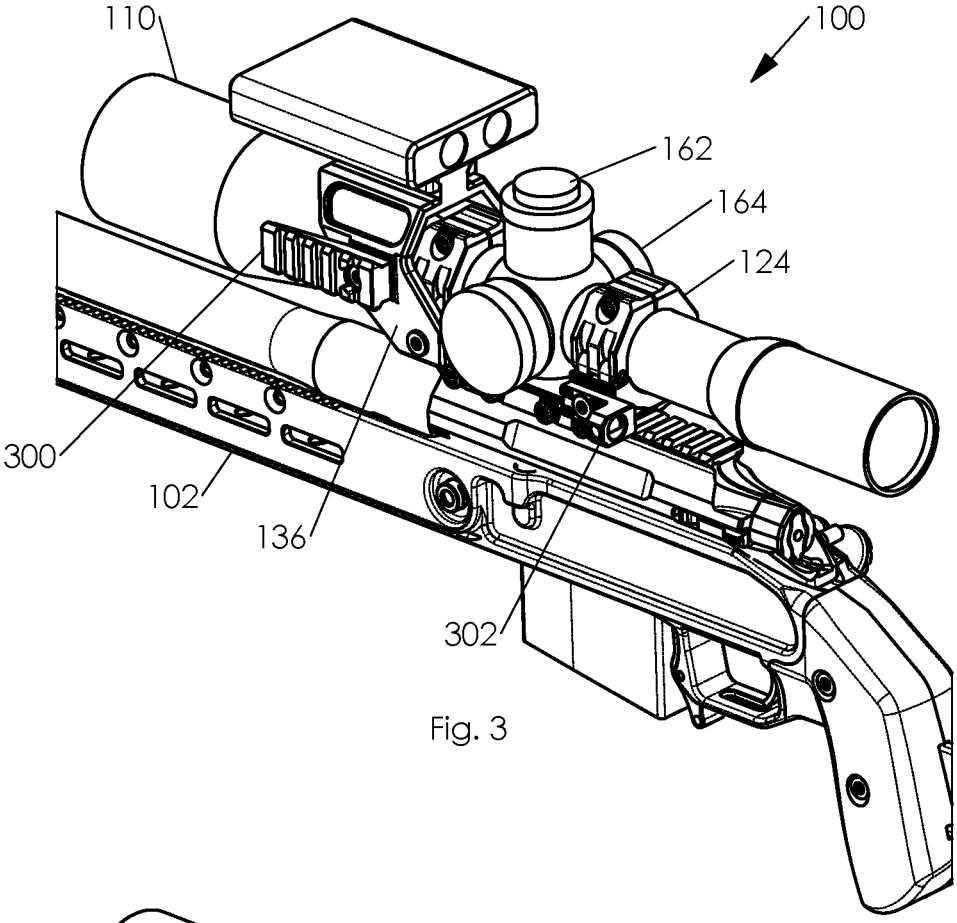
FIG. 3 is a detailed left-side isometric view of a portion of the firearm and the targeting assembly.
Figure 4:
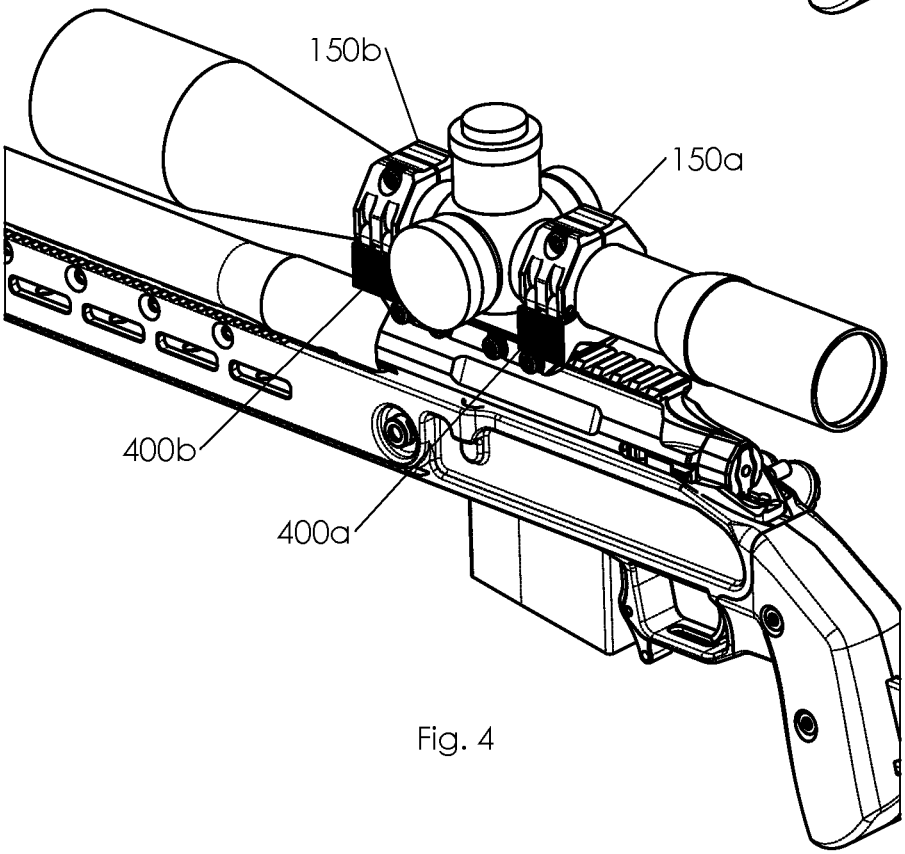
FIG. 4 is a detailed left-side view of the targeting assembly with accessories removed.

FIG. 3 is a left-side rear isometric view of the firearm 102. FIG. 4 shows the scope mount 124 without the mounting accessories 136, 300, 302 shown in FIG. 3. Referring now to FIG. 3, the accessories 300, 302 are spaced apart from the dials 162, 164 to allow for windage or elevation setting adjustments. The accessory 300 is in the form of a Picatinny rail and the accessory 302 is in the form of a sight leveler. Referring now to FIG. 4, the scope rings 150*a*, 150*b* include serrated interfaces 400*a*, 400*b*, respectively. The scope rings 150*a*, 150*b* can be generally similar to each other, and the description of one of the scope rings 150 applies equally to the other, unless indicated otherwise. Example features of scope rings are discussed in connection with FIGS. 24-33.

The serrated interfaces between the accessories 302, 300 and the scope mount 124 can maintain one or more positional relationships between those accessories and the scope 110, thereby maintaining alignment and aiming functionality of the targeting assembly 100. The accessories 300, 302 can be locked to the scope mount 124 such that the positional relationships are maintained even if the accessories are struck by an object. For example, the accessories can be struck by branches, rocks, a user's body, or other objects.

Figure 5:
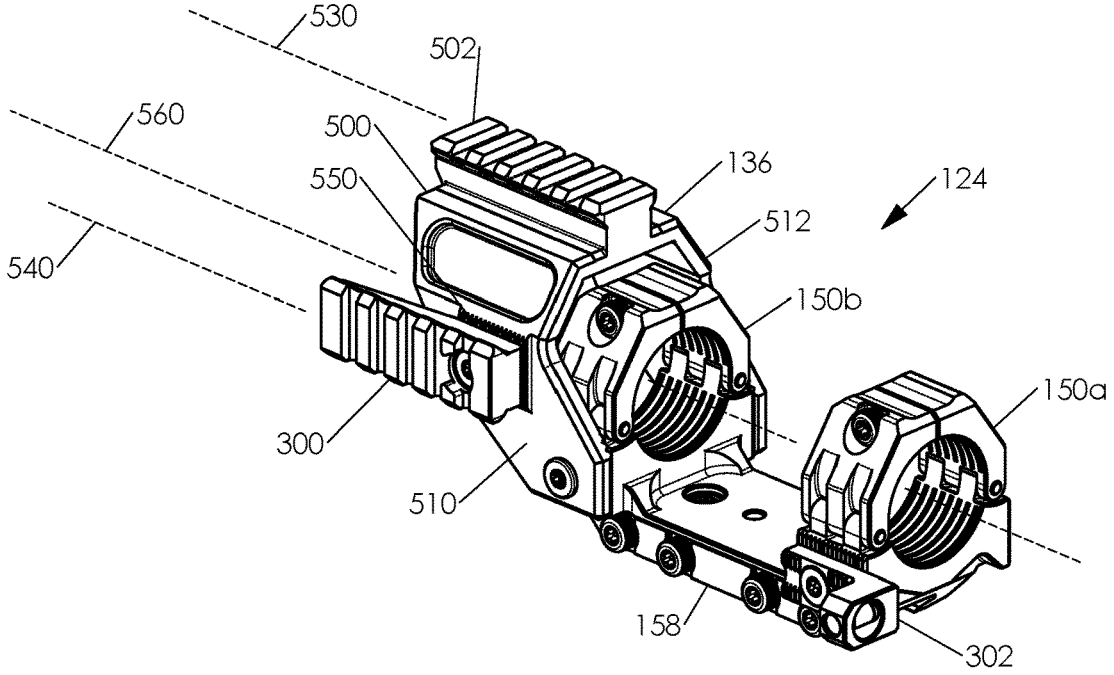
FIG. 5 is an isometric view of a targeting assembly, in accordance with some embodiments.
Figure 6:
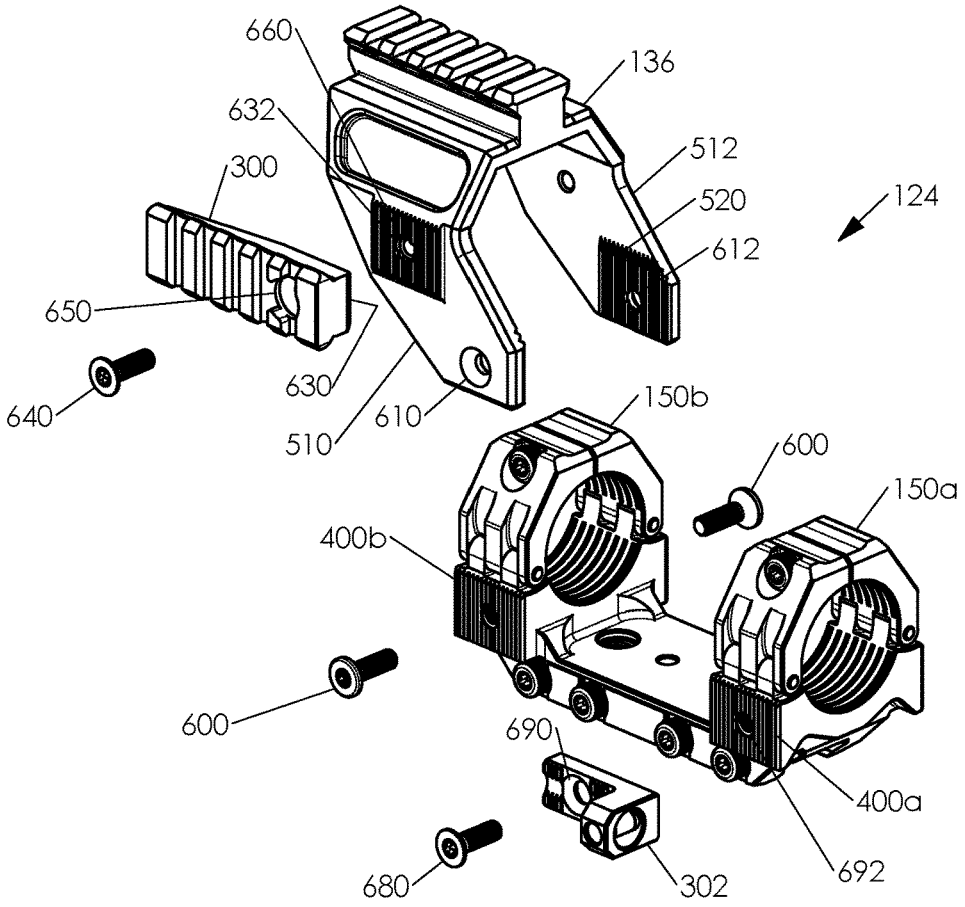
FIG. 6 is an exploded isometric view of the targeting assembly of FIG. 5.

FIG. 5 is an isometric view of the scope mount 124, in accordance with some embodiments. FIG. 6 is an exploded isometric view of the scope mount 124. Referring now to FIG. 5, the accessory mount 136 can be generally U-shaped to surround the scope ring 150*b* and can include a main body 500 including an accessory mounting rail 502, a first leg 510, and a second leg 512. The first and second legs 510, 512 can each have serrated leg interfaces (serrated interface 520 is shown in FIG. 6) that interlock with serrated interfaces of the scope mount 124. For example, the serrated interfaces can interlock with a corresponding interface 400*b* on either side of the scope ring 150*b* to hold the accessory mount 136 aligned with the scope ring 150*b*, thereby maintaining alignment between the laser device 120 and the scope 110. To mount the accessory mount 136, the interfaces (e.g., interface 520) can be slid into the interfaces 400*b*. As the interfaces 520 slide along the interfaces 400*b*, they can decontaminate the interfaces 400*b*, 520 by, for example, pushing out contaminates from the interface grooves. A fastener 600 can then be inserted through holes 610, 612 of the legs 510, 512 to hold the interfaces against one another. The fastener 600 can be a threaded member, a screw, or another coupler. The interlocked serrated interfaces 520, 400*b* can maintain one or more positional relationships between accessories and a scope, thereby maintaining alignment.

Referring to FIG. 5, the rails 300, 502 can be aligned to provide precision mounting of accessories. For example, a longitudinal axis 530 of the rail 502 and a longitudinal axis 540 of the rail 300 can be generally parallel. In some embodiments, a longitudinal axis 560 of the scope mount 124 can be aligned with one or both of axes 530, 540. When a scope is retained by the scope mount 124, the scope can be aligned with one or more of the axes 530, 540, 560. In some embodiments, one or more of the axes 530, 540, 560 can be generally parallel to a midsagittal plane (e.g., midsagittal plane or midplane 1600 of the scope mount 124 in FIG. 16) to maintain relationships between various mounted components to maintain functionality of the assembly.

Referring to FIGS. 5 and 6, the rail 300 can have an integral serrated interface 630 (FIG. 6) configured to mate with serrated interface 632 (FIG. 6) of the accessory mount 136. A fastener 640 can be inserted through a through-hole 650 of the rail 300 and into an internally threaded through-hole 660 of the serrated interface 632. The fastener 640 can be torqued to compress the interlocked interfaces 630, 632, thereby fixing together the rail 300 and the accessory mount 136. The second leg 512 can have a similar serrated interface for mounting an additional component.

Referring now to FIG. 6, the sight leveler 302 can be coupled to the scope ring 150 by inserting a fastener 680 through a through-hole 690 and into a threaded hole 692 of the serrated interface 400*a*. The orientation of the sight leveler 302 can be fixed with respect to the scope ring 150*a* to maintain the positional relationship between the sight leveler 302 and the scope (e.g., scope 110 of FIGS. 1 and 2). Additionally, the sight leveler 302 is reversibly mountable because of it's dual-sided serrated interfaces, as discussed in connection with FIGS. 10 and 11.

Figure 7:
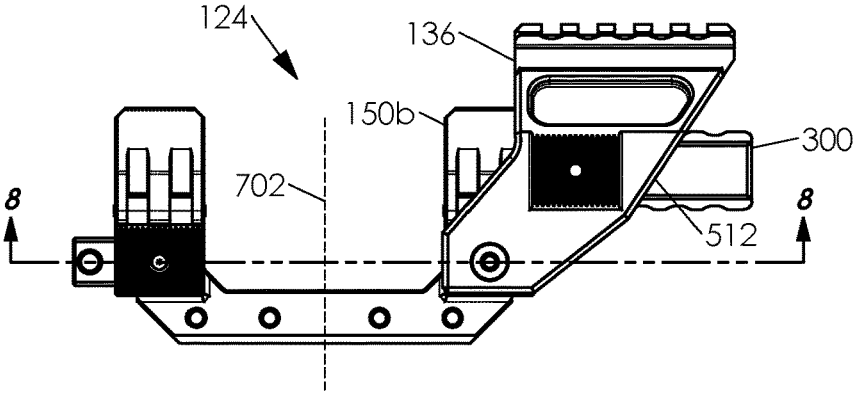
FIG. 7 is a right-side view of the targeting assembly of FIG. 5.
Figure 8:
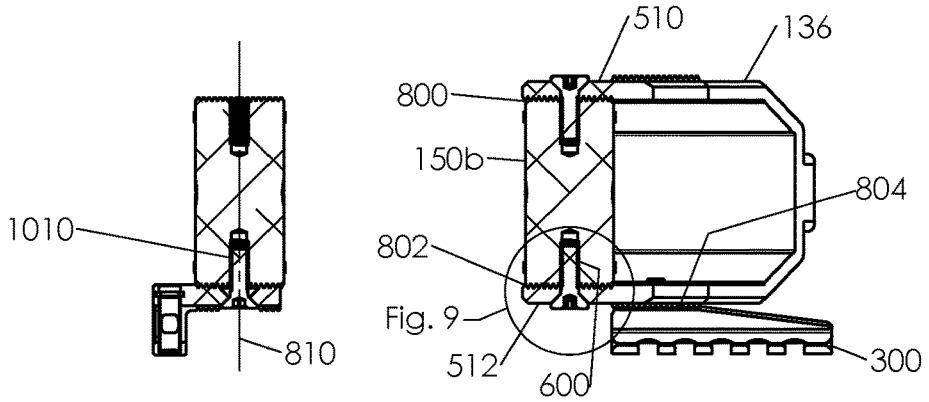
FIG. 8 is a cross-sectional view of the targeting assembly taken along a line 8-8 of FIG. 7.
Figure 9:
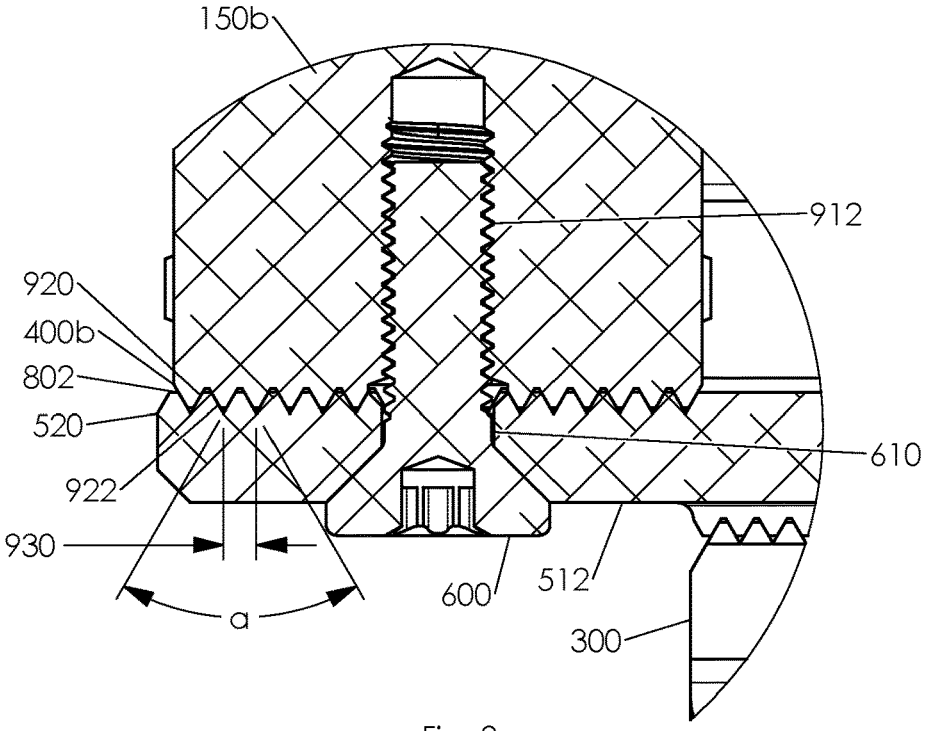
FIG. 9 is a detailed view of a portion of the targeting assembly of FIG. 8.

FIG. 7 is a side view of the scope mount 124, in accordance with some embodiments. FIG. 8 is a cross-sectional view taken along line 8-8 of FIG. 7. FIG. 9 is a detailed view of an interface of FIG. 8. Referring now to FIG. 8, the accessory mount 136 and the scope ring 150*b* form interlocked joints or interfaces 800, 802. The description of one of the interfaces 800, 802 applies to the other interface, unless indicated otherwise. Referring now to FIG. 9, the interface 802 is formed by the serrated interface 520 of the leg 512 and an interface 400*b* of the scope ring 150*b* and can include a hole to receive fastener 600. For example, the interface 520 includes the hole 610, and the interface 400*b* includes a hole 912.

The interface 520 can include a plurality of evenly or unevenly spaced apart serrations (one serration 922 is labeled in FIG. 9) that define peaks and valleys for receiving complementary-shaped serrations 920 of the interface 400*b*. In some embodiments, the serrations 922 can define included angles $\alpha$ within a range of, for example, 50 degrees to 70 degrees, 55 degrees to 65 degrees, or other ranges. In one embodiment, the angle $\alpha$ can be, for example, 50 degrees, 55 degrees, 60 degrees, 65 degrees, 70 degrees, or other suitable angles. A width 930 of the serrations 922 can be selected based on the structural requirements of the application (e.g., anticipated externally applied loads, tactile feedback during installation, etc.). In some embodiments, the width 930 can be, for example, 1 millimeter, 1.5 millimeters, 2 millimeters, 2.5 millimeters, 3 millimeters, or other distances selected based on the desired positioning. The alternating ridges and grooves of the interface 520 can vary in size, shape, and/or spacing, depending on the intended application.

The serrations 920, 922 can have profiles that are symmetrical, asymmetrical, or a combination of both, depending on the desired performance characteristics. In some embodiments, the serrations 920, 922 can be tooth-shaped, truncated-triangular-shaped, or have other shapes, including sinusoidal shapes, sawtooth shapes, or the like. The characteristics of the serrations (e.g., hardness, surface finish, etc.) can impact the interfaces' performance. In some embodiments, the surfaces of the interface 802 can be made, in whole or in part, of steel, titanium, aluminum, plastics, or the like.

The interface 802 can significantly increase the contact area between the mated components 150*b*, 136 as compared to smooth surfaces. This enhanced contact area can, for example, reduce fastening torques required to prevent relative motion between the components on either side of the joint. Additionally, the interface 802 can be damage tolerant. For example, the interface 802, if damaged, can be easily repaired to restore maximum performance. For example, if a serration becomes damaged, the damaged portion can be fixed or removed (e.g., removed using a file). This allows for in-field repairs of damaged serrations. The serrations of the interface 802 are complementarily-shaped (e.g., geometrically congruent, matching, etc.) to ensure that the scope ring 150*b* and second leg 512 maintain solid contact throughout use. The interface 802 can also increase the friction resistance due to the increased contact area and multiple contact points along the ridge and grooves. This can enhance the secure grip, torque transmission between components, and/or resistance to relative motion. The interface 802 can also provide tactile feedback indicating, for example, when the components 150*b*, 136 are properly interlocked and capable of withstanding high externally applied loads.

The configuration of the serrations 400*b*, 520 can provide for the expulsion of contaminants from the interface 802 to help maintain the integrity of the contact surfaces over repeated installation of the accessory mount 136. For example, if the firearm is transported, the accessory mount 136 can be removed from the scope mount 124. During installation, contaminants (e.g., mud, water, etc.) may be located along the interfaces 400*b*, 520, and those contaminants can be pushed out by sliding the interfaces 400*b*, 520 relative one another. The serrations 400*b*, 520 can also maintain a stable support of the accessory to ensure an accuracy threshold of the scope is met even when a fastener is torqued below a threshold. For example, if the fastener loosens to 4 Nm from a target or threshold torque (e.g., a threshold torque of 5 Nm), the serrations continue to lock the accessory to the scope mount 124. The serrated interfaces of the mounting accessory and the interface can be aligned. The fasteners can be gradually tightened and torqued at, for example, 5 Nm, 5.8 Nm, 6 Nm, 6.2 Nm, 6.4 Nm, or 6.6 Nm. In some embodiments, the features 922 can be, for example, teeth (e.g., pointed teeth, truncated teeth, etc.), curve features, ridges, texture surfaces, or the like. The positions, number, and/or depth of the serrations can be selected to reduce the required torque of a fastener to keep an accessory securely mounted on the scope mount 124.

Referring now to FIGS. 7 and 9, the serrations 920, 922 can extend in a direction generally parallel to a reference plane (e.g., a coronal or frontal plane 702 of the scope mount 124 of FIG. 7). For example, longitudinal axes of the serrations 920, 922 can be within a range of about ±2 degrees or ±1 degree of parallel with respect to the coronal plane 702 such that the aiming axis of a scope (e.g., scope 110 of FIGS. 1 and 2) is generally perpendicular to the coronal plane 702. The orientation of the serrations 920, 922 can be selected based on the orientation of the accessory.

Figure 10:
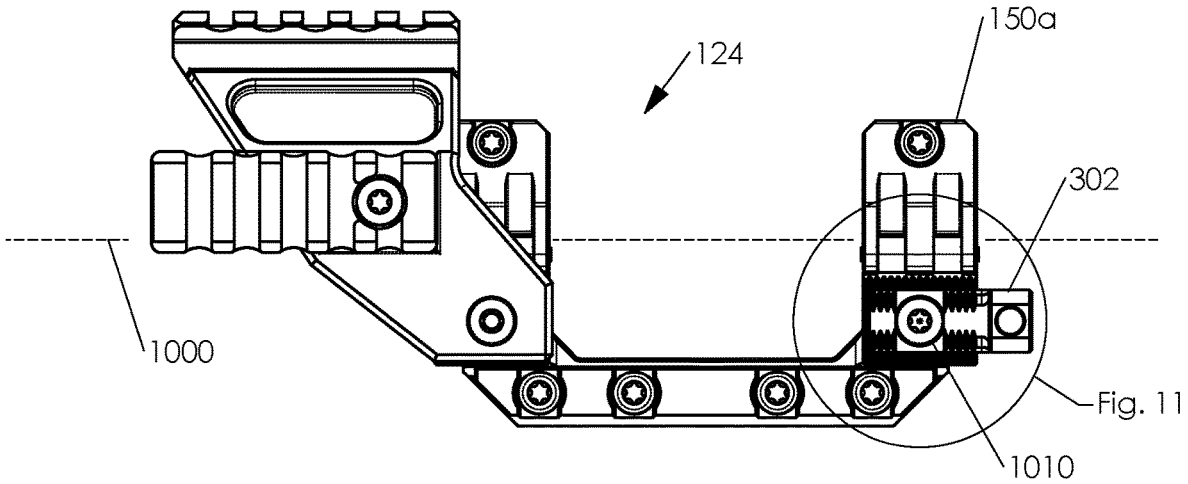
FIG. 10 is a left-side view of the targeting assembly, in accordance with one embodiment.
Figure 11:
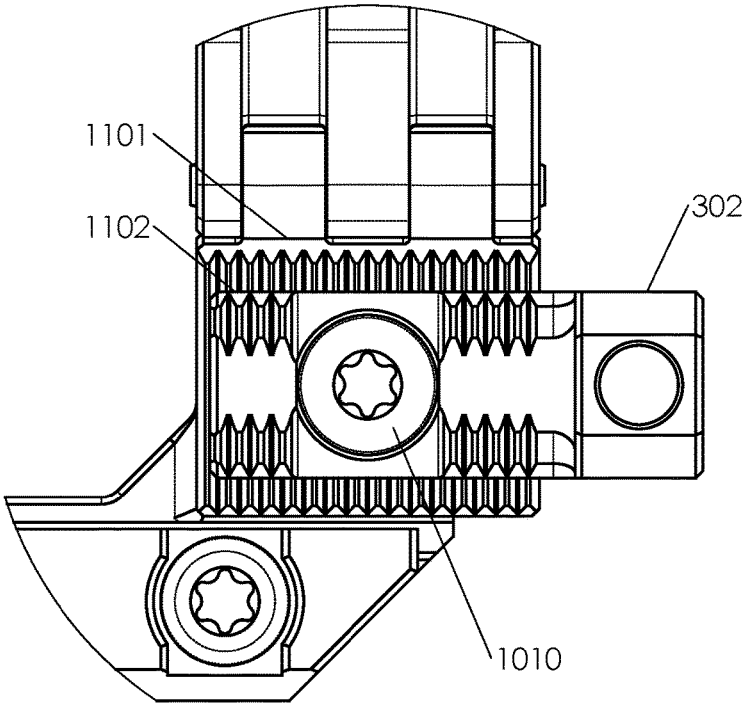
FIG. 11 is a detailed view of a portion of the targeting assembly of FIG. 10.

FIG. 10 shows the scope mount 124 with the sight leveler 302 aligned with a longitudinal axis 1000 of the scope mount 124. FIG. 11 is a detailed view of a portion of the scope mount 124. The sight leveler 302 is rotationally fixed to the scope ring 150*a* relative to a longitudinal axis 810 (FIG. 8) of the fastener 1010. The junction between the scope ring 150*a* and the sight leveler 302 can have serrations oriented in a generally vertical direction when the longitudinal axis 1000 is at a horizontal orientation.

FIGS. 10 and 11 depict another modular scope mount 124 in which separated scope rings incorporate serrations to which various accessories can be connected. The serrated interfaces can be incorporated into the design of the scope mount or separate scope rings and other accessory mounts in a modular way, enabling a person to configure the mounting system as may be required. For example, referring now to FIG. 11, the sight leveler 302 can interlock with a serrated interface 1101 of the scope ring 150*a* and can include an outwardly facing serrated interface 1102 mountable to an interface for reversing the orientation of the sight leveler 302. In some embodiments, another component can be placed against serrated interface 1102 and be held by the fastener 1010. Any number of accessories can be stacked together and the interfaces can be geometrically congruent for interchangeability of components.

Figure 12:
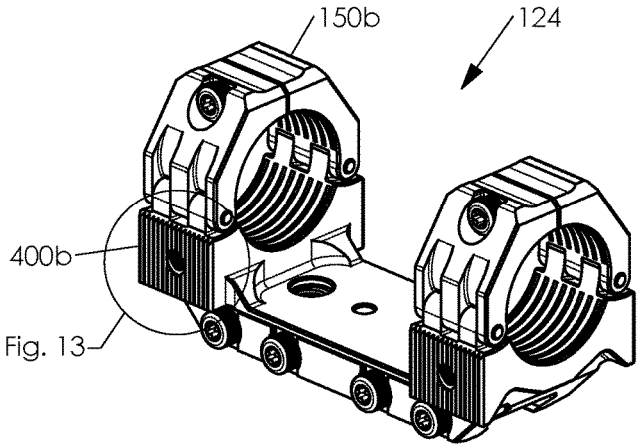
FIG. 12 is an isometric view of a scope mount, in accordance with some embodiments.
Figure 13:
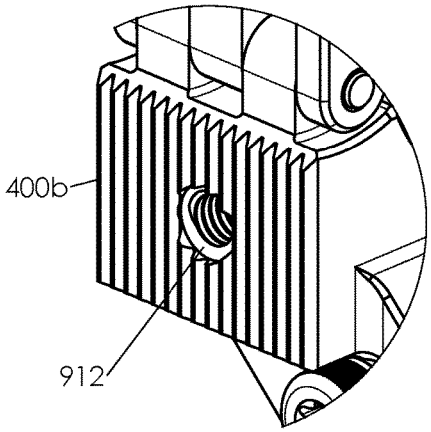
FIG. 13 is a detailed view of a serrated interface of FIG. 12.

FIG. 12 is an isometric view of the scope mount 124, in accordance with some embodiments. FIG. 13 is a detailed view of the interface 400*b* of scope ring 150*b*. The interface 400*b* includes serrations that extend in a generally vertical direction when the scope mount 124 is in a general horizontal orientation. In some embodiments, the longitudinal axis of most or all of the serrations can be aligned (e.g., generally parallel), as shown in FIG. 13. The hole 912 can be positioned generally centrally within the interface 400*b*. This allows compressive forces to be distributed generally evenly over the interface 400*b*.

Figure 14:
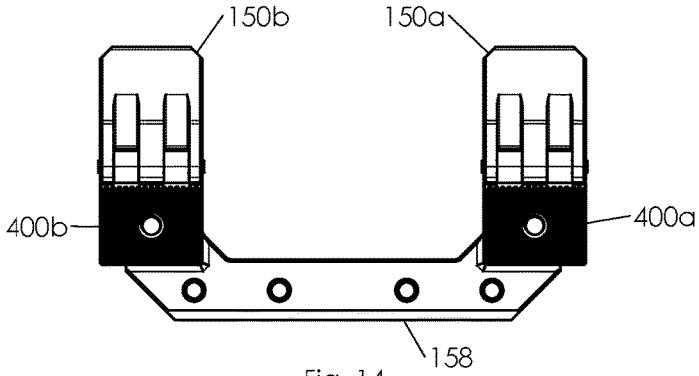
FIG. 14 is a side view of the scope mount of FIG. 12.
Figure 15:
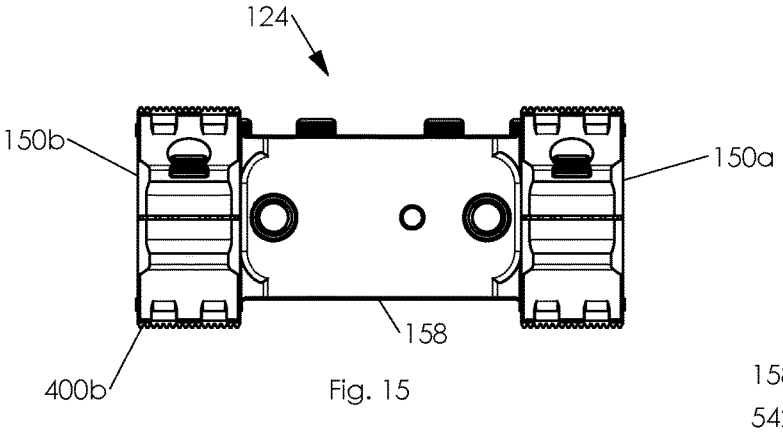
FIG. 15 is a top view of the scope mount of FIG. 12.
Figure 16:
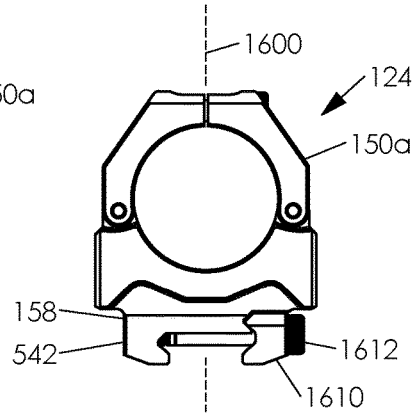
FIG. 16 is a back view of the scope mount of FIG. 12.

As shown in FIGS. 14-16, each of the scope rings 150*a*, 150*b* can have serrated interfaces on opposing sides so that accessories can be mounted at various locations along the scope mount 124. FIG. 16 shows a mounting clamp 158 including a clamping mechanism 542. The clamping mechanism 542 can include one or more clamping members 1610 and fasteners 1612. Example operation and features of clamp mechanisms are discussed in connection with FIG. 26.

Figure 17:
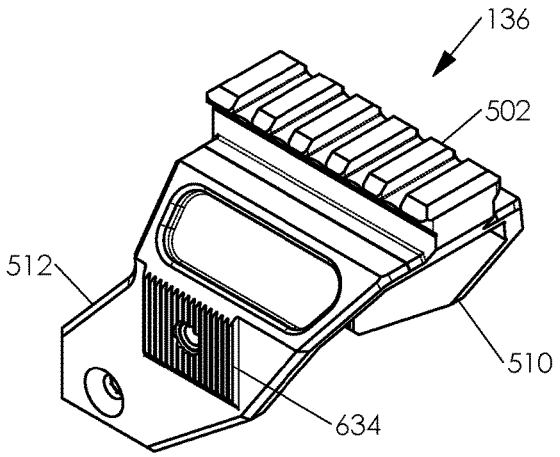
FIG. 17 is an isometric view of a primary accessory mount, in accordance with some embodiments.
Figure 18:
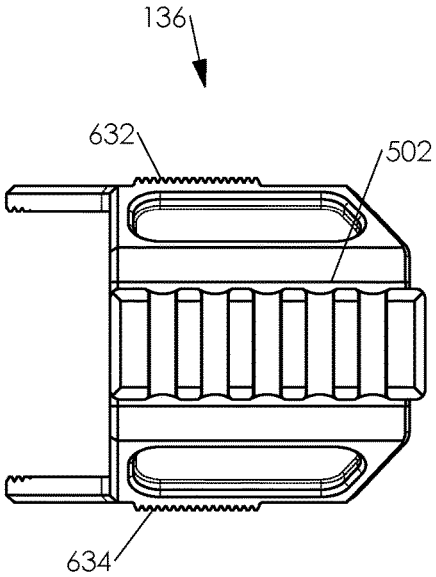
FIG. 18 is a top view of the primary accessory mount of FIG. 17.
Figure 19:
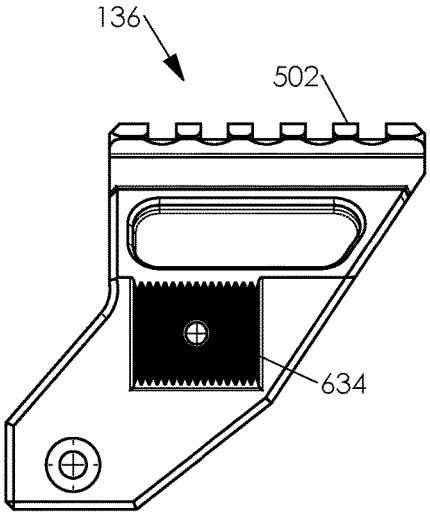
FIG. 19 is a side view of the primary accessory mount of FIG. 17.
Figure 20:
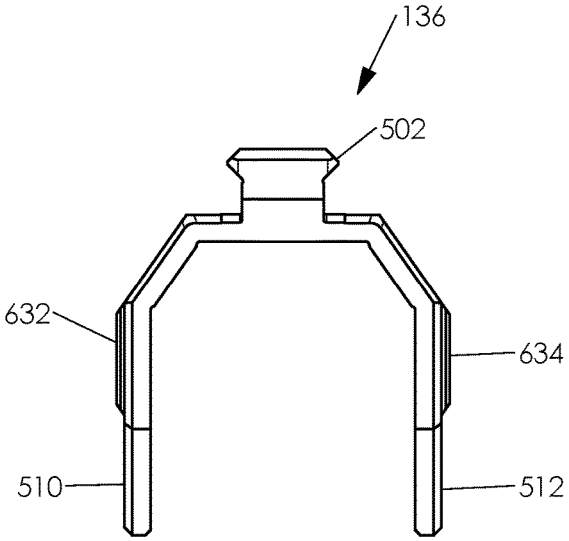
FIG. 20 is a front view of the primary accessory mount of FIG. 17.

FIG. 17 is an isometric view of the accessory mount 136, in accordance with some embodiments. FIG. 18 is a top view of the accessory mount 136. FIG. 19 is a side view of the accessory mount 136. FIG. 20 is a front view of the accessory mount 136. The accessory mount 136 can have a general U-shaped configuration (see FIG. 20) with serrated interfaces or sidewall interfaces 632, 634. The description of one of the interfaces 632, 634 applies to the other unless indicated otherwise. The serrated interfaces 632, 634 are configured to enmesh with serrated interfaces of other components to mount components to the sides of the accessory mount 136.

Figure 21:
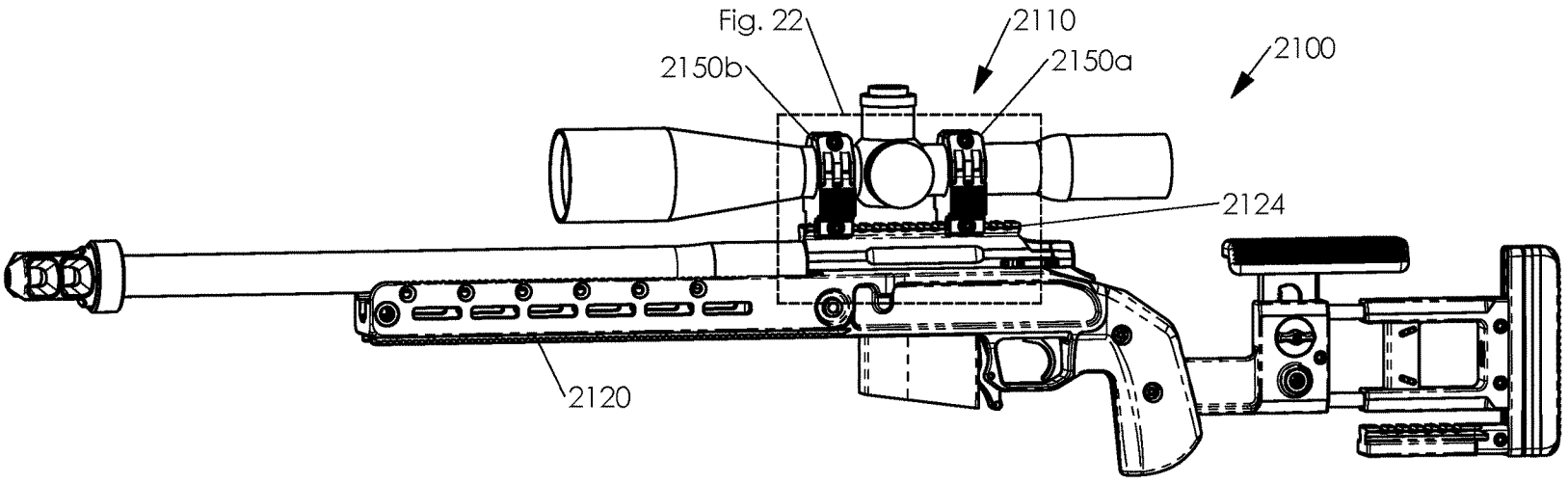
FIG. 21 is a side view of a firearm carrying scope rings having serrated interfaces.
Figure 22:
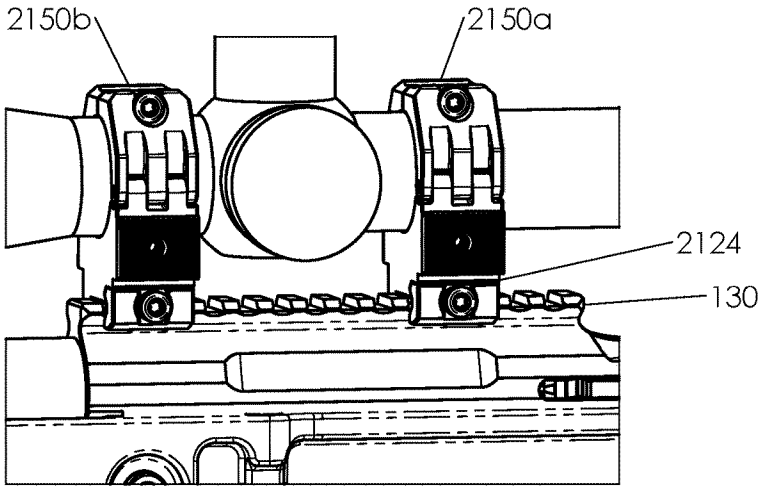
FIG. 22 is a detailed view of a portion of the firearm and the scope rings of FIG. 21.
Figure 23:
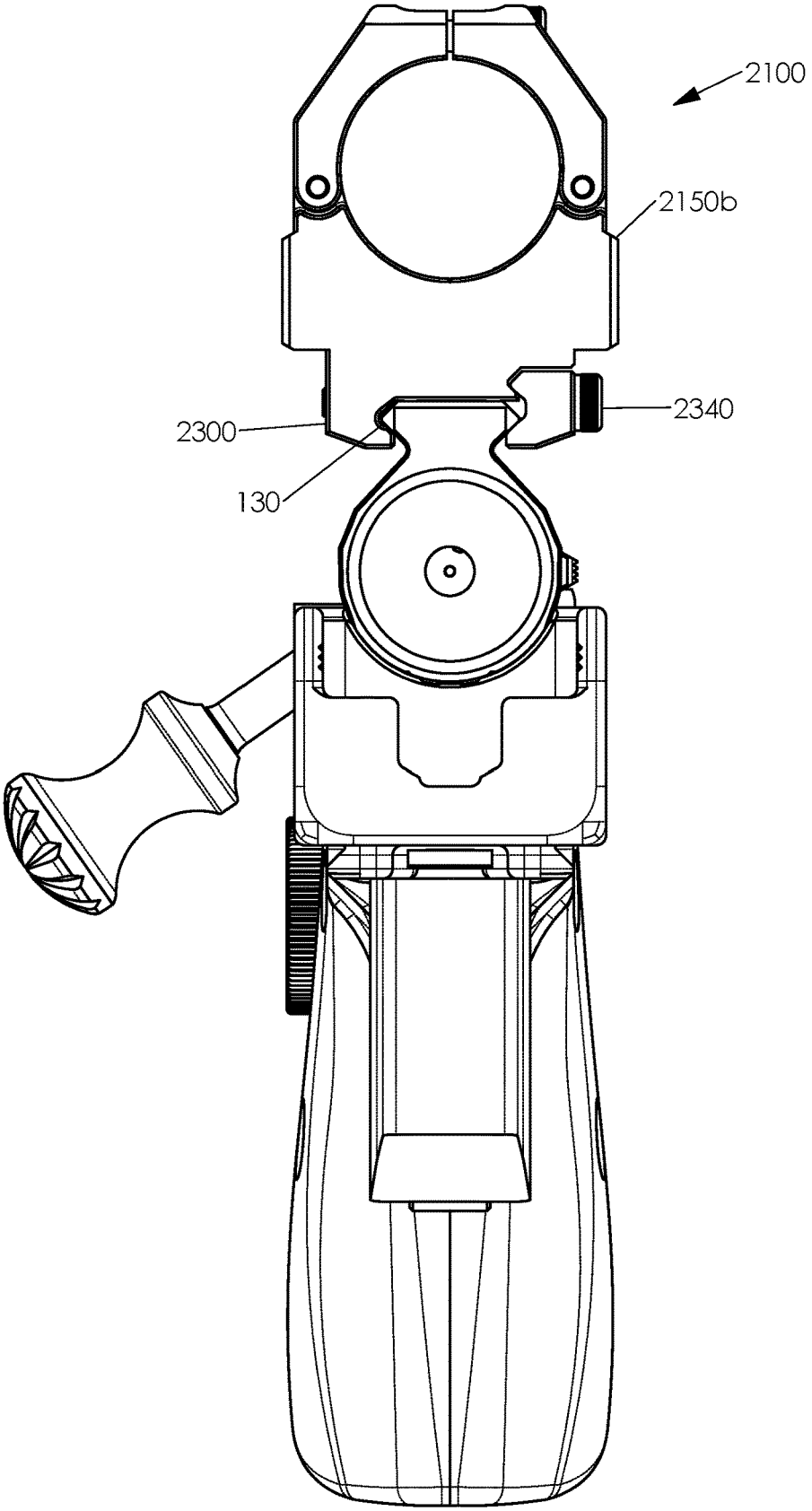
FIG. 23 is a front view of the firearm of FIG. 21.

FIG. 21 is a side view of a firearm assembly 2100 and a sighting assembly 2110. FIG. 22 is a detailed view of a portion of the firearm assembly 2100 and the sighting assembly 2110. As shown in FIG. 22, serrated interfaces of scope rings 2150*a*, 2150*b* are exposed to allow for convenient accessory installation on the sides of a scope mount 2124. The scope rings 2150*a*, 2150*b* can be independently moved along with the mounting rail 130. Referring now to FIG. 23, a clamp or clamp mechanism 2300 ("clamp 2300") of the scope ring 2150*a* can be opened to release the mounting rail 130. A fastener 2340 can be rotated to close the clamp 2300 on the mounting rail 130. Features of scope rings, scope clamps, mounting rails, and other features of firearms are disclosed in U.S. Pat. No. 8,871,666, filed on Jul. 28, 2019, titled "Scope Ring Mounting Clamps for Firearms," which is incorporated by reference in its entirety.

Figure 24:
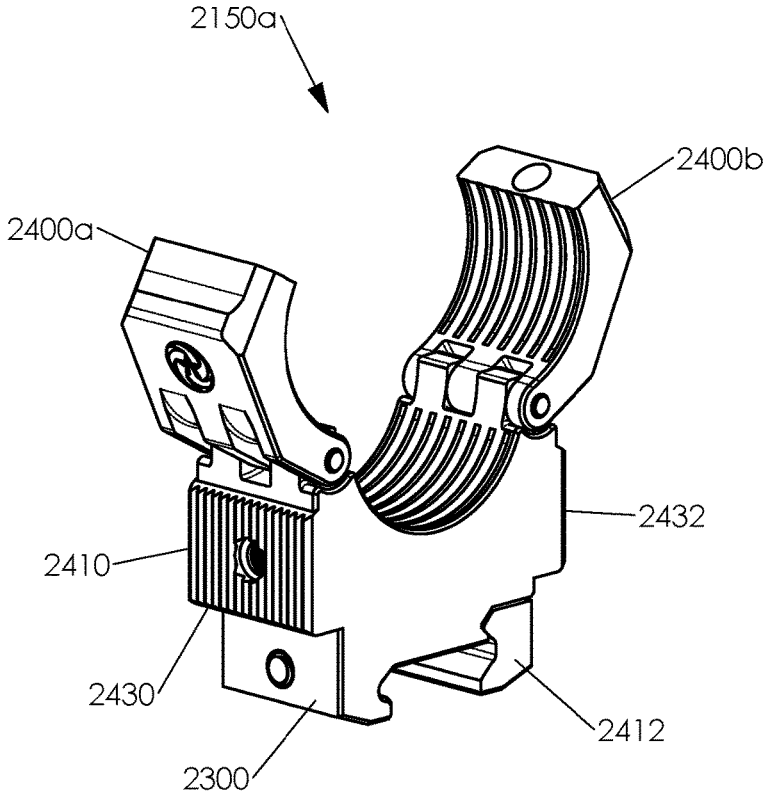
FIG. 24 is an isometric view of a scope ring in an open position, in accordance with some embodiments.
Figure 25:
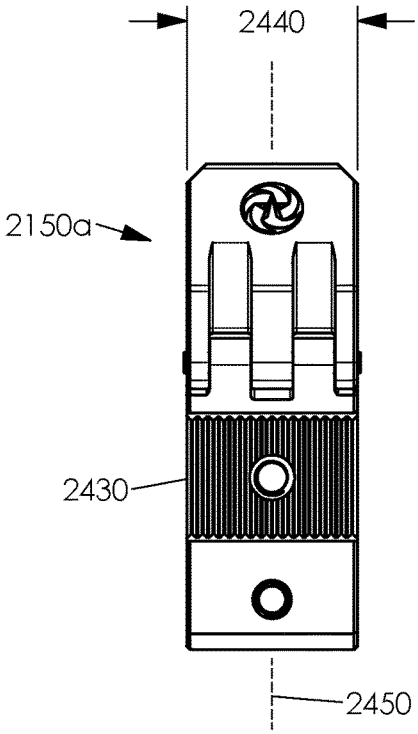
FIG. 25 is a side view of the scope ring of FIG. 24 in a closed position.

FIG. 24 is an isometric view of the scope ring 2150*a* including arcuate ring caps 2400*a*, 2400*b*, a ring base 2410 configured to cooperate with the arcuate ring caps 2400*a*, 2400*b* to define an opening for receiving a scope, and the clamp 2300 connected to the ring base 2410. The ring base 2410 includes integral serrated interfaces 2430, 2432 that are spaced apart from the arcuate ring caps 2400. Accessories can remain attached to the scope ring 2150*a* while allowing opening and closing of the arcuate ring caps 2400*a*, 2400*b* to, for example, install, reposition, or remove a scope. As shown in FIG. 25, the serrated interface 2430 can extend along the length 2440 of the scope ring 2150*a* to provide a relatively large mounting area. Serrations of the serrated interface 2430 can be generally parallel to a coronal or frontal plane 2450 of the scope ring 2150*a*. The serrated interface 2430 can extend between most of a distance between the clamp mechanism 2300 and the arcuate ring cap 2400*a*, 2400*b*. The serrated interface 2430 can include a plurality of evenly spaced apart serrations along most of length 2440, which is generally aligned (e.g., generally parallel) with an axis of a scope-receiving opening of the scope ring 2150*a*.

Figure 26:
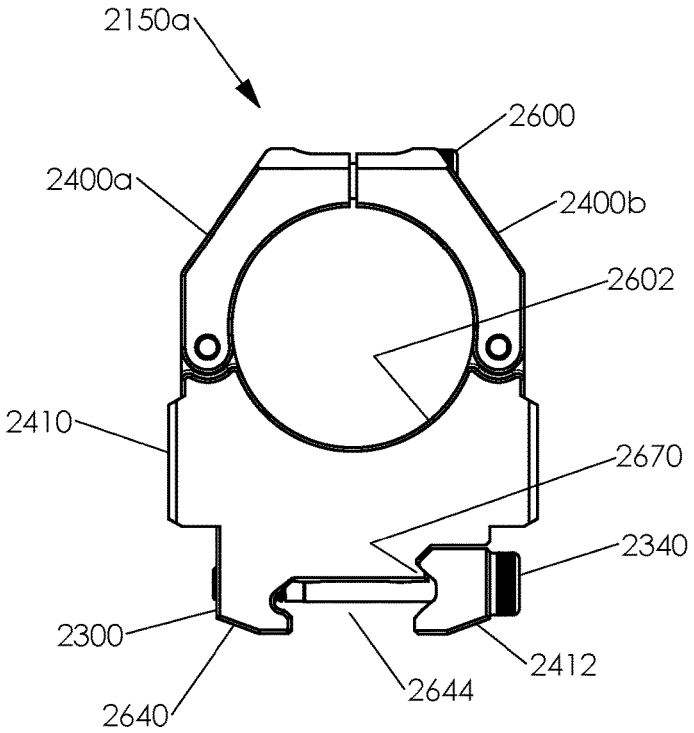
FIGS. 26 and 27 are front and top views of the scope ring in the closed position.
Figure 27:
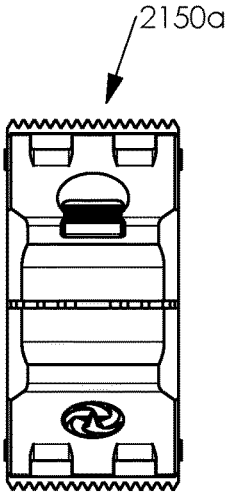

Referring now to FIG. 26, the scope ring 2150*a* can include one or more fasteners 2600 for coupling together the arcuate ring caps 2400*a*, 2400*b*. A curved inner surface 2602 can surround or contact the circumference of a portion of the scope and can be formed by the ring base 2410 and the arcuate ring caps 2400*a*, 2400*b*. In some embodiments, the arcuate ring caps 2400*a*, 2400*b* collectively surround about half of the circumference of a tubular section of the scope. In other embodiments, the arcuate ring caps 2400*a*, 2400*b* can surround more than half of the circumference of the tubular section of a scope, and the ring base 2410 can surround less than half of the circumference of the tubular section of the scope. The configuration and sizes of the components of the scope ring 2150*a* can be selected based on the desired forces to be applied to the ring scope.

Referring to FIG. 26, the fixed portion 2640 of the ring base 2410 can cooperate to form a receiving channel 2644 for receiving a mounting rail. The fastener 2340 can be used to move the clamp member 2412 (FIGS. 24 and 26) to adjust a width of the receiving channel 2644. To assemble the clamp 2300, the fastener 2340 can be inserted through the clamp member 2412 and threaded into a threaded hole of the fixed portion 2640. To couple the clamp 2300 to a firearm, the mounting rail of the firearm can be inserted into the receiving channel 2644. The clamp member 2412 can then be moved toward the fixed portion 2640 to grip the mounting rail 130, as shown in FIG. 23. The ring base 2410 can include one or more shoulders 2670 to limit inward movement of the clamp 2412. In the illustrated embodiment, the shoulder 2670 allows the lower end of the clamp 2412 to rotate clockwise to clamp onto a lower portion of a mounting rail.

The ring base 2410 can include other types of mechanisms (e.g., clamps, brackets, pins, screws, fastener assemblies, etc.) for coupling to other types of mounting features (e.g., rails, brackets, pin holes, screw holes, or the like, or to other components, such as a receiver, a barrel, or the like) of a firearm. The configuration of the mechanisms can be selected based on a design of the firearm. In some embodiments, the ring base 2410 can be incorporated into a mounting rail clamp, such as mounting rail clamp of FIG. 2.

Figure 28:
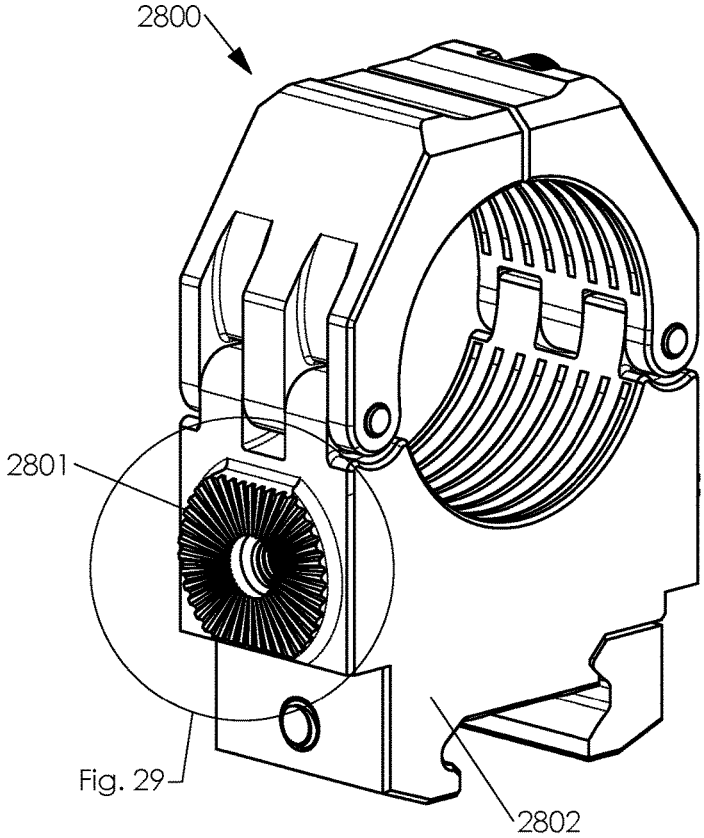
FIG. 28 is an isometric view of a scope ring, in accordance with another embodiment.
Figure 29:
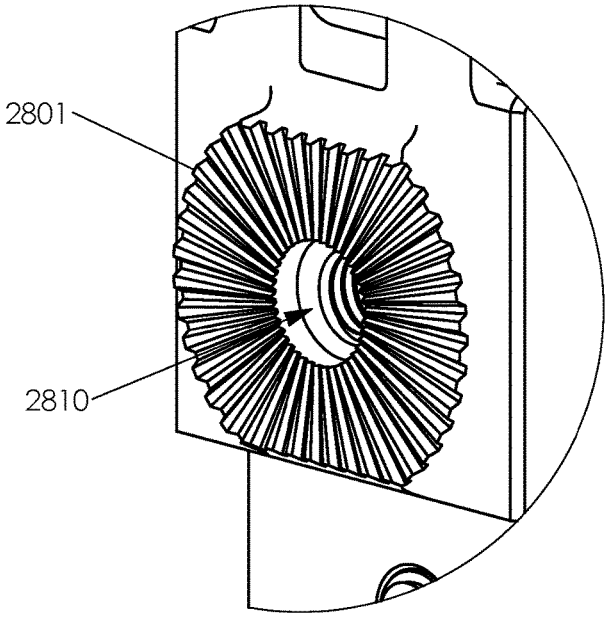
FIG. 29 is a detailed view of a serrated interface of the scope ring of FIG. 28.

FIG. 28 is an isometric view of a scope ring 2800, in accordance with another embodiment. FIG. 29 is a detailed view of the scope ring 2800 of FIG. 28. The description of the scope rings of FIGS. 1-27 applies equally to the scope ring 2800, unless indicated otherwise. Referring now to FIGS. 28 and 29, the scope ring 2800 includes a serrated interface 2801 positioned along a side of a ring base 2802. The opposing side of the ring base 2802 can also include a similar serrated interface or another type of serrated interface, such as a serrated interface with parallel serrations, herringbone patterned serrations (see, e.g., FIGS. 30-31), or other patterns. Referring now to FIG. 29, the serrated interface 2801 can include radially extending serrations. In some embodiments, the serrated interface 2801 is in the form of a Hirth coupling configured to mate with a complementary-shaped Hirth coupling of an accessory. The interlocked couplings can form a Hirth joint. The number, size, angular position, and serration parameters can be selected based on the application.

Figure 30:
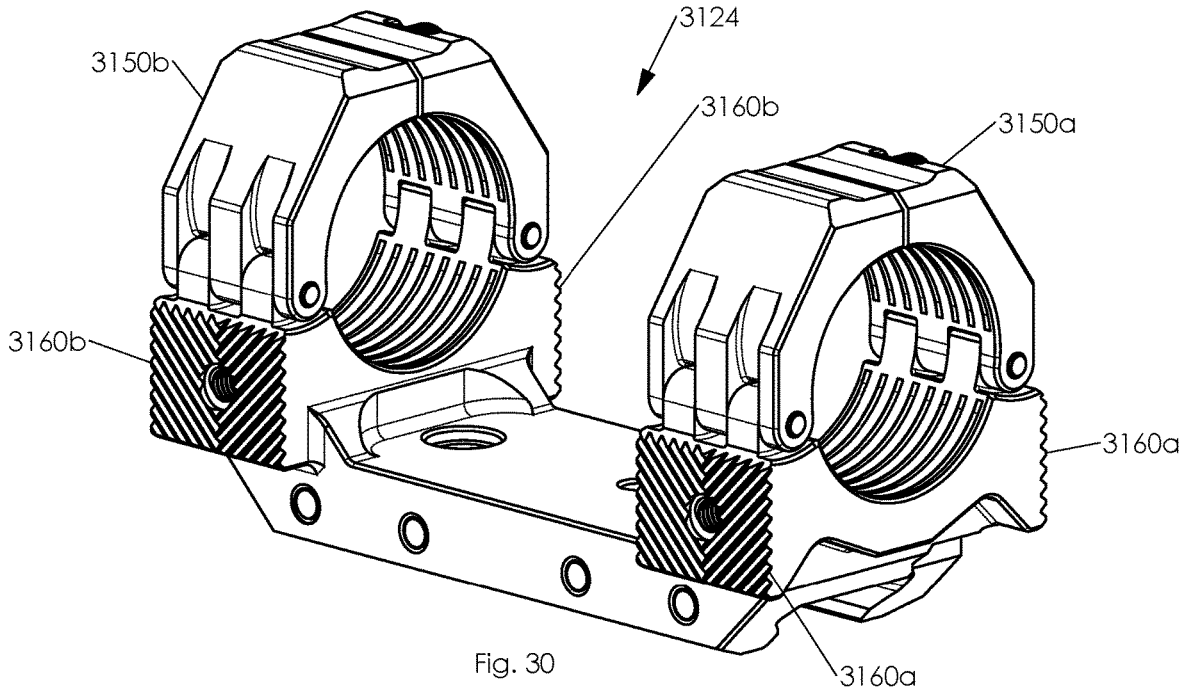
FIG. 30 is an isometric view of a scope mount, in accordance with another embodiment.
Figure 31:
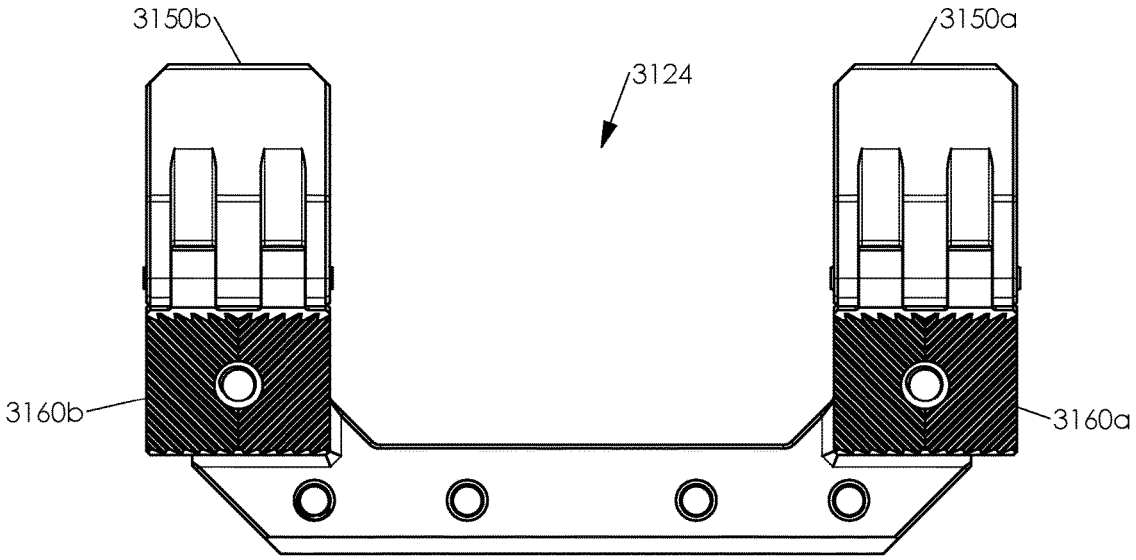
FIG. 31 is a side view of the scope mount of FIG. 30.

FIG. 30 is an isometric view of a scope mount 3124, in accordance with another embodiment. FIG. 31 is a side view of the scope mount 3124 of FIG. 30. The description of the scope mounts of FIGS. 1-16 applies equally to the scope mount 3124, unless indicated otherwise. The scope mount 3124 can include ring clamps 3150*a*, 3150*b* having serrated interfaces 3160*a*, 3160*b*, respectively. The serrated interfaces 3160*a*, 3160*b* can have serrations in a herringbone pattern (illustrated), wavey pattern, or the like. In some embodiments, the scope mount 3124 includes combinations of different types of interfaces, such as herringbone interfaces (illustrated), radial or Hirth interfaces (see, e.g., FIGS. 28-29), straight serration interfaces (see, e.g., FIGS. 1-27), or the like. The interfaces disclosed herein can also be positioned along the firearm. This allows accessories to be connected directly to the firearm.

Figure 32:
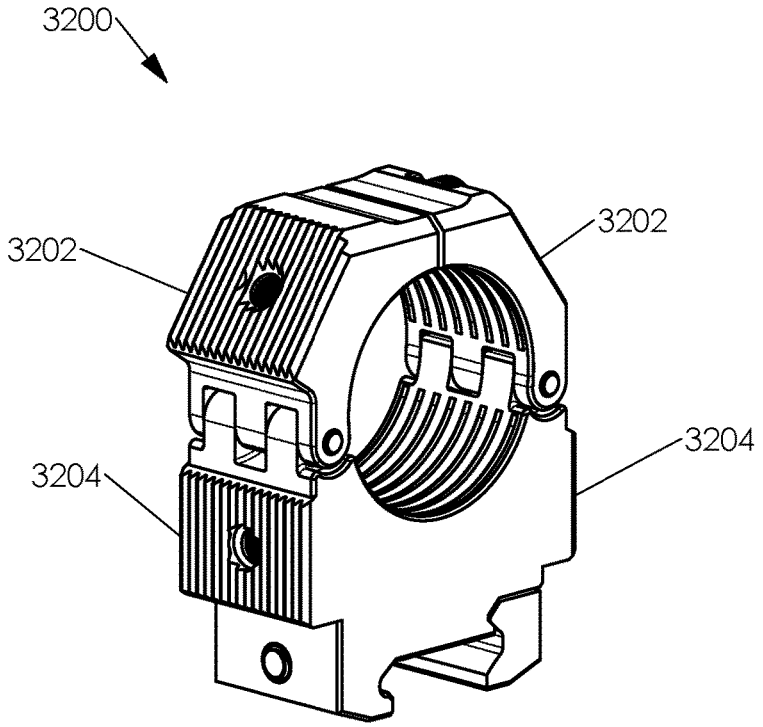
FIG. 32 is an isometric view of a scope ring, in accordance with another embodiment.

FIG. 32 is an isometric view of a scope ring 3200, in accordance with another embodiment. The description of the scope rings of FIGS. 1-31 applies equally to the scope ring 3200, unless indicated otherwise. The scope ring 3200 has serrated interfaces 3202 positioned along ring caps and serrated interfaces 3204 positioned along a ring base. The serrated interfaces 3202 can be complementary-shaped to the serrate interfaces 3204. This allows components to be moved between the interfaces 3202, 3204. The interface 3202 can be angled with respect to the interface 3204 to allow accessories to be installed at various circumferential positions about the scope. In some embodiments, lightweight or small components can be mounted to the serrated interface 3202 while the scope ring 3200 remains in a closed configured. This allows for removal and installation of accessories without affecting the scope calibrations or settings (e.g., leveling, rotational position, reticle focus, etc.).

Figure 33:
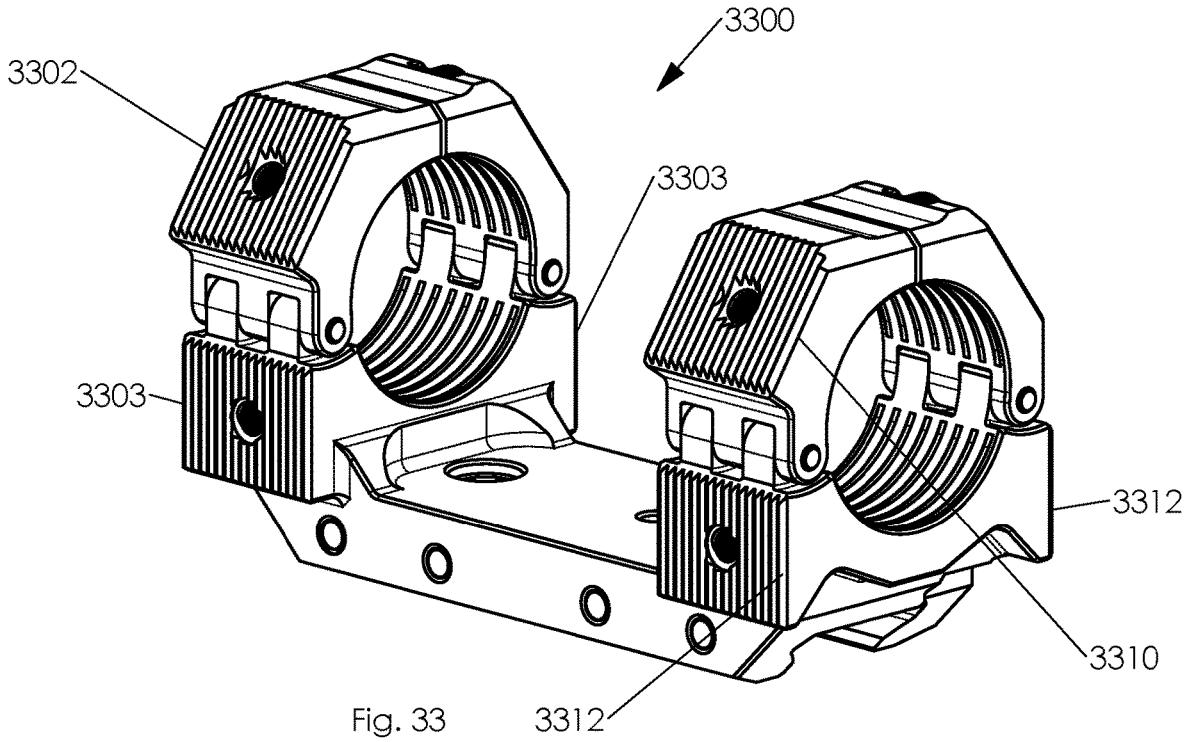
FIG. 33 is an isometric view of a scope mount, in accordance with another embodiment.

FIG. 33 is an isometric view of a scope mount 3300 with integrated scope rings, in accordance with another embodiment. The description of the scope mounts and features of FIGS. 1-32 apply equally to the scope mount 3300, unless indicated otherwise. The scope mount 3300 can include a scope ring having serrated interfaces 3302, 3303 and a scope ring with serrated interfaces 3310, 3312. Accessories can be mounted to the serrated ring base and serrated ring caps for various configurations.

The embodiments, features, systems, devices, materials, methods, and techniques described herein may, in some embodiments, be similar to any one or more of the embodiments, features, systems, devices, materials, methods, and techniques described in the following:

- U.S. Pat. No. 7,743,543, filed on Oct. 6, 2005, titled "TRIGGER MECHANISM AND A FIREARM CONTAINING THE SAME";
- U.S. Pat. No. 8,171,666, filed on Jul. 28, 2009, titled "SCOPE MOUNTING CLAMPS FOR FIREARMS";
- U.S. Pat. No. 8,572,885, filed on Jan. 12, 2011, titled "MOUNTING CLAMPS FOR COUPLING SCOPES TO MOUNTING RAILS OF FIREARMS";
- U.S. Pat. No. 9,097,478, filed on Feb. 19, 2013, titled "BOLT MECHANISMS AND FIREARMS CONTAINING THE SAME";
- U.S. Pat. No. 9,574,834, filed on Jun. 26, 2015, titled "BOLT MECHANISMS AND FIREARMS CONTAINING THE SAME";
- U.S. Pat. No. 10,458,733, filed on Jan. 17, 2017, titled "BOLT MECHANISMS AND FIREARMS CONTAINING THE SAME";
- U.S. Pat. No. 9,377,255, filed on Feb. 3, 2015, titled "MULTI-CALIBER FIREARMS, BOLT MECHANISMS, BOLT LUGS, AND METHODS OF USING THE SAME";
- U.S. Pat. No. 10,082,356, filed on Jun. 27, 2016, titled "MULTI-CALIBER FIREARMS, BOLT MECHANISMS, BOLT LUGS, AND METHODS OF USING THE SAME";
- U.S. Pat. No. 10,982,921, filed on Sep. 17, 2018, titled "FIREARM BARREL PRE-LOADING DEVICES, CONNECTION ASSEMBLIES, AND FIREARMS";
- U.S. Pat. No. 11,067,347, filed on Dec. 2, 2019, titled "FIREARM BOLT ASSEMBLY WITH A PIVOTING HANDLE";
- U.S. application Ser. No. 17/211,727, filed on Mar. 24, 2021, titled "FIREARM BARREL PRE-LOADING DEVICES, CONNECTION ASSEMBLIES, AND FIREARMS";
- U.S. App. 62/590,224, filed on Nov. 22, 2017, titled "EXTRACTOR RETAINED WITHIN BOLT ASSEMBLY";
- U.S. App. 62/590,232, filed on Nov. 22, 2017, titled "FIREARM SPRING RETENTION DEVICE";
- U.S. App. 62/590,236, filed on Nov. 22, 2017, titled "SCOPE RING ASSEMBLY";
- U.S. App. 62/590,239, filed on Nov. 22, 2017, titled "FIRING MECHANISM WITH ADJUSTABLE SEAR";
- U.S. App. 62/590,243, filed on Nov. 22, 2017, titled "RECOIL LUG AND ACCESSORY RAIL AND ANTI-ROTATION INTERFACES"; and
- U.S. application Ser. No. 17/348,672, filed on Jun. 15, 2021, titled "FIREARM BOLT ASSEMBLY WITH A PIVOTING HANDLE."

All of the above-identified patents and applications are incorporated by reference in their entireties. In addition, the embodiments, features, systems, devices, materials, methods, and techniques described herein may, in certain embodiments, be applied to or used in connection with any one or more of the embodiments, features, systems, devices, or other matter. For example, the embodiments, features, extractors, bolt mechanisms, bolt assemblies, components, methods, and techniques described herein may, in some embodiments, be used with, be similar to, and/or include any one or more of the embodiments, features, firing components, systems, devices, materials, methods, and techniques described in U.S. Pat. Nos. 7,743,543; 8,572,885; U.S. patent application Ser. No. 13/771,021, U.S. Provisional Patent Application No. 61/600,477; and U.S. Provisional Patent Application No. 61/602,520. U.S. Pat. No. 7,743,543; U.S. patent application Ser. No. 13/771,021, U.S. Provisional Patent Application No. 61/600,477; and U.S. Provisional Patent Application No. 61/602,520 are incorporated herein by reference in their entireties. In addition, the embodiments, features, systems, devices, materials, methods, and techniques described herein may, in certain embodiments, be applied to or used in connection with any one or more of the embodiments, firearms, features, systems, devices, materials, methods, and techniques disclosed in the above-mentioned U.S. Pat. No. 7,743,543; U.S. Provisional Patent Application No. 61/600,477; and U.S. Provisional Patent Application No. 61/602,520. The mounting components and other features disclosed herein can be configured for use with and/or incorporated into a wide range of different firearms (e.g., rifle, pistol, or other portable gun) to receive cartridges and remove empty cartridge shells. The following patents and applications are incorporated by reference: U.S. Pat. Nos. 7,743,543; 8,572,885; 9,097,478; 9,377,255. Sighting and targeting assemblies can include, without limitation, sights, scope, cameras (e.g., with or without sights and/or scopes), guidance systems (e.g., AR/VR guidance systems), targeting systems, and other mounting assemblies and components disclosed herein.

From the foregoing, it will be appreciated that specific embodiments of the invention have been described herein for purposes of illustration, but well-known structures and functions have not been shown or described in detail to avoid unnecessarily obscuring the description of at least some embodiments of the invention. All patents, applications, and publications referenced herein are hereby incorporated by reference in their entireties. Where the context permits, singular or plural terms may also include the plural or singular term, respectively. Unless the word "or" is associated with an express clause indicating that the word should be limited to mean only a single item exclusive from the other items in reference to a list of two or more items, then the use of "or" in such a list shall be interpreted as including (a) any single item in the list, (b) all of the items in the list, or (c) any combination of the items in the list. The singular forms "a," "an," and "the" include plural referents unless the context clearly indicates otherwise. Thus, for example, reference to "a screw" refers to one or more screws, such as two or more screws, three or more screws, or four or more screws.

These and other changes can be made to the embodiments in light of the above-detailed description. In general, in the following claims, the terms used should not be construed to limit the claims to the specific embodiments disclosed in the specification and the claims but should be construed to include all possible embodiments along with the full scope of equivalents to which such claims are entitled. Accordingly, the claims are not limited by the disclosure.

What is claimed is:

1. A scope mounting system for a firearm, comprising:

a scope mounting assembly configured to couple to the firearm and including:

a rail clamp configured to couple to a mounting rail of the firearm;

at least one scope ring connected to the rail clamp; and at least one serrated interface that is spaced apart from the rail clamp and configured to engage a complementary-shaped serrated interface of a component such that the component is rotationally and translationally fixed to the scope mounting assembly to maintain a positional relationship between the component and a scope held by the at least one scope ring, wherein the at least one serrated interface includes a plurality of saw-tooth shaped serrations, and a through-hole configured to receive a fastener to hold the complementary-shaped serrated interface against the plurality of saw-tooth shaped serrations, wherein the through-hole is surrounded by the saw-tooth shaped serrations.

2. The scope mounting system of claim 1, wherein the plurality of saw-tooth shaped serrations are generally evenly spaced apart from one another.

3. The scope mounting system of claim 1, further comprising a complementary-shaped serrated interface of a component configured to move against the serrated interface so that angled-mated faces of the at least one serrated interface and the complementary-shaped serrated interface interlock.

4. The scope mounting system of claim 1, wherein the saw-tooth shaped serrations extends in a direction generally parallel to a coronal plane of the scope mounting assembly.

5. The scope mounting system of claim 1, wherein the saw-tooth shaped serrations are oriented in a vertical direction when a longitudinal axis of the scope mounting assembly is oriented in a horizontal direction.

6. The scope mounting system of claim 1, wherein the at least one serrated interface includes a first serrated interface and a second serrated interface, wherein the scope mounting assembly further comprises an accessory mount including:

a main body including an accessory mounting rail;

a first leg connected to the main body having a first serrated leg interface; and a second leg connected to the main body having a second serrated leg interface, wherein the first and second serrated leg interfaces are configured to engage the first and second serrated interfaces, respectively.

7. The scope mounting system of claim 6, further comprising:

a first threaded fastener configured to extend through the first serrated interface and the first serrated leg interface; and a second threaded fastener configured to extend through the second serrated interface and the second serrated leg interface.

8. The scope mounting system of claim 6, wherein the through-hole is a first threaded hole, wherein:

the first serrated interface includes the first threaded hole configured to receive a first threaded coupler; and the second serrated interface includes a second threaded hole configured to receive a second threaded coupler.

9. The scope mounting system of claim 1, further comprising a U-shaped accessory mount having serrated interfaces that enmesh with the at least one serrated interface to fixedly couple the U-shaped accessory mount to the scope mounting assembly.

10. The scope mounting system of claim 1, wherein the at least one serrated interface includes a first serrated interface, wherein the scope mounting assembly includes:

an accessory mounting rail including a second serrated interface configured to interlock with the first serrated interface.

11. The scope mounting system of claim 10, wherein the first and second serrated interfaces include interlocking ridges and grooves.

12. The scope mounting system of claim 1, wherein the at least one serrated interface includes a set of evenly spaced apart and geometrically congruent ridges.

13. An assembly device coupleable to a firearm, the assembly device comprising:

a rail clamp configured to couple to a mounting rail of the firearm;

at least one scope ring; and at least one serrated interface configured to mechanically connect a device for targeting, data acquisition, data transmitting, and/or data receiving, wherein the at least one serrated interface is spaced apart from the rail clamp and configured to engage an interface of the device such that the device is rotationally and translationally fixed to the assembly device, wherein the at least one serrated interface includes a plurality of saw-tooth shaped serrations, and a through-hole surrounded by the saw-tooth shaped and configured to receive a fastener to hold the interface of the device against the at least one serrated interface.

14. The assembly device of claim 13, wherein the at least one scope ring is configured to hold a scope and includes the at least one serrated interface.

15. The assembly device of claim 13, wherein the plurality of saw-tooth shaped serrations are generally evenly spaced apart from one another.

16. The assembly device of claim 13, wherein the plurality of saw-tooth shaped serrations each have a cross-sectional width less than 3 millimeters.

17. The scope mounting system device of claim 1, wherein the plurality of saw-tooth shaped serrations each have a cross-sectional width less than 3 millimeters.

* * * * *